US005839027A

United States Patent [19]

Sahay et al.

[11] Patent Number: 5,839,027

[45] Date of Patent: Nov. 17, 1998

[54] MAGNET LESS SEALABLE DEVELOPER CARTRIDGE

[75] Inventors: Ravi B. Sahay, San Diego, Calif.; Henry L. Alioth, Las Vegas, Nev.

[73] Assignee: Ravi & Associates, San Diego, Calif.

[21] Appl. No.: 885,532

[22] Filed: Jun. 30, 1997

[51] Int. Cl.[6] ..... G03G 15/08

[52] U.S. Cl. ..... 399/106; 399/119; 399/263

[58] Field of Search ..... 399/119, 234, 399/258, 263, 102, 103, 105, 106, 262

[56] References Cited

U.S. PATENT DOCUMENTS

| | | | |
|---|---|---|---|
| 4,460,267 | 7/1984 | Ogawa | 355/222 |
| 4,974,023 | 11/1990 | Aimoto | 355/245 |
| 5,063,412 | 11/1991 | Hirsch | 355/259 |
| 5,153,649 | 10/1992 | Park | 399/110 |
| 5,419,468 | 5/1995 | Taki | 222/554 |
| 5,475,478 | 12/1995 | Nishimura et al. | 399/119 |
| 5,491,537 | 2/1996 | Suzuki | 355/245 |
| 5,585,902 | 12/1996 | Nishiuwatoko et al. . | |
| 5,592,268 | 1/1997 | Uehara et al. | 399/276 |
| 5,608,501 | 3/1997 | Makino | 399/119 |

*Primary Examiner*—Robert Beatty
*Attorney, Agent, or Firm*—Frank G. Morkunas

[57] ABSTRACT

A removable, sealable, magnet-less cartridge for use in a reproduction apparatus of the type having a control device to control the apparatus, a photoreceptor to receive toner through a photoreceptor path and to transfer the toner onto imaged portions of the photoreceptor, and a developer transporter of the magnetic type to carry toner in a magnetic brush to the imaged portions of the photoreceptor and to return unspent toner therefrom. The magnet-less cartridge device has a housing adjacent to the developer transporter; a developer mix hopper and a mixer within the housing for holding and mixing toner and a carrier therefor in the form of a developer mix; a scraper at an open end of the housing in communicating adjacency of the developer transporter; and a sealing device including a first movable sealing member, a second movable sealing member, each of which are adjacent to the open end of the housing and in operational communication with the control means to seal the cartridge in a plurality of sealing modes.

18 Claims, 2 Drawing Sheets

MAGNET LESS SEALABLE DEVELOPER CARTRIDGE

STATEMENT REGARDING FEDERALLY-SPONSORED RESEARCH OR DEVELOPMENT

Not applicable.

CROSS REFERENCES TO RELATED APPLICATIONS

None.

BACKGROUND OF THE INVENTION

1. Field of the Invention

The present invention relates generally to development cartridges for printing and copying devices, and more particularly to development cartridges for electrophotographic printers and copiers utilizing magnetic brush structures to handle a developer material and deposit toner therefrom onto a photoreceptor.

2. Description of Related Art

For many years xerographic development cascade processes were utilized in printers and copiers for the development of latent images borne on a photo conductive media. In modern electrophotographic copiers and printers, however, the conventional cascade xerographic process is seldom used, primarily due to the undesirably large size of its necessary components and its relatively low process speed. Instead, a development process commonly referred to as "magnetic brush" development is now widely used in place of the cascade xerographic development process.

In a conventional magnetic brush developer system utilized in an electrophotographic printer or copier, a suitable mechanism transports a developer mix to a photoreceptor (this mechanism is referred to herein as developer transporter). This developer transporter usually is configured with a fixed magnet inside and a rotating cylinder outside, is rotated within a sump structure, or hopper, in which a predetermined quantity of dry developer mix is disposed. The developer mix generally consists of a magnetically attractable carrier material and a dry toner material removably adhered thereto.

The rotating developer transporter attracts a quantity of the developer mix which magnetically adheres to its outer side surface, with the carrier portion of the attracted developer mix being externally coated with toner and projecting radially outwardly from the rotating developer transporter in bristle-like fashion thus giving that side surface of the developer transporter the appearance of a very soft and agitative "brush" or bristle-like appearance.

The magnetically attached quantity of developer mix is then rotated past a metering device which "trims" the radially projecting developer mix 'bristles' to a predetermined, generally uniform length. The trimmed developer mix rotationally exiting the metering device is then rotated into close adjacency with a side surface portion of a rotating photoreceptor. Before it is brought into adjacency with the trimmed developer mix on the magnetic developer transporter, the negatively charged "background" areas, and discharged "image" areas (corresponding to the printed indicia to be transferred to paper stock operatively fed through the printer or copier), are formed on the side surface portion of a rotating photoreceptor.

Toner from the trimmed developer mix is electrically drawn toward the previously discharged imaged areas of the photoreceptor surface portion. The toner-covered discharged areas on the photoreceptor are then rotated into adjacency with the paper stock being fed through the copy or print machine, and the toner from the discharged photoreceptor areas is electrically drawn onto the paper stock (typically by a corotron) and thermally cured thereon.

The photoreceptor side surface portion from which toner has been transferred to the moving paper stock is then sequentially rotated past a cleaning blade which removes residual toner from the photoreceptor portion, past a discharge lamp device which removes residual electrical charge from the photoreceptor, past a charging device (such as a scorotron) which negatively charges the photoreceptor, and past a discharge device (such as a digitally controlled laser beam) which forms the electrically discharged image areas on the otherwise negatively charged photoreceptor. The photoreceptor is then again rotated into adjacency with a trimmed quantity of developer mix externally carried by the developer transporter.

After a given portion of the trimmed developer mix carried by the rotating magnetic developer transporter has transferred its toner constituent to the rotating photoreceptor, the now toner-depleted developer mix remains magnetically attracted to the developer transporter and is rotated back into the toner sump or hopper which time additional non-depleted developer mix is magnetically attracted to the depleted developer mix and passed across metering device on its way again to the side surface of the rotating photoreceptor. This conventional developer transfer scheme, used in conjunction with magnetic brush development, is commonly used in copies and printers today. Recently, switchable magnetic brush systems, especially for color development systems, have been disclosed which use electromagnets to establish a rotating magnetic brush to propel the developer mix onto the developer transporter. U.S. Pat. No. 5,063,412 issued on Nov. 5, 1991, to Hirsh and U.S. Pat. No. 5,523,824 issued on Jun. 4, 1996, to Sahay address the magnetic-brush concept.

The majority of printer and copiers and their respective toner cartridges for use as described above are made as all-in-one toner cartridges. This means that the cartridge unit itself contains an imaging photoreceptor, a developer transporter with a development (magnet) roll therein, and the developer mix and related mechanisms. As so configured, the cartridge is a consumable and must be replaced after the developer mix has been depleted. This usually occurs after 1500–3000 copies have been produced. Replacement cartridges range in cost from between $50–90 with the cost-per-copy for monochrome usually exceeding three cents per copy.

Few vendors use a two-cartridge system rather than the all-in-one approach. In these situations, vendors bundle the imaging photoreceptor separately from the developer mix cartridge. Still, in these systems the developer transporter is either bundled with the photoreceptor or with the developer mix cartridge also yielding a high price tag for the end-user.

It can readily be seen from the foregoing that it would be highly desirable to provide copiers and printers of this variety with a removable non-magnetic, sealable, and cleanable toner cartridge which would eliminate, or at least significantly reduce, the aforementioned problems, limitations, and disadvantages which typically are associated with conventional magnetic brush development apparatus.

The all-in-one cartridges available today are convenient to replace but they are expensive and wasteful. The life of the photoreceptor can be up to one million impressions and the developer transporter can easily last for the life of the printer or copier. Depending on the size of the hopper or reservoir containing the developer mix, the mixture therein can last from between 1,500 to 20,000 copies. Moreover, in a color printer or copier, because of the multiple color requirements of cyan, magenta, yellow, and black, the photoreceptor and the four-toner supply systems cannot be economically and easily bundled together in all-in-one cartridges.

U.S. Pat. No. 5,103,264 issued on Apr. 7, 1992, to Bhagat discloses an all-in-one cartridge having a photoreceptor, a development roll (developer transporter), and the developer mix in a reservoir. Such cartridges for monochrome and color machines suffer from the following disadvantages:

(a) makes the cartridge expensive on a cost-per-copy basis because the development system, mixture, and photoreceptor are packaged together in the same cartridge;

(b) not environmentally-friendly in that it is difficult to recycle such development rolls along with the photoreceptor;

(c) requires more space around the circumference of the photoreceptor and is not suitable for color machines;

(d) operates more slowly in the color development mode; and (e) impractical for color processing because of the lack of space noted in (c), above, and the slowness of operation as noted in (d), above.

U.S. Pat. No. 4,460,267, issued on Jul. 17, 1984, to Ogawa discloses a removable cartridge housing having a shutter, a developer transporter, and a magnet member within the developer transporter. The shutter covers the magnetic brush on the developer transporter when the cartridge is removed. U.S. Pat. No. 5,608,501 issued on Mar. 4, 1997, to Makino discloses a development unit and toner cartridge system, in which a developer transporter is an integral part of the photoreceptor unit. U.S. Pat. No. 5,491,537 issued on Feb. 13, 1996, to Suzuki discloses a cartridge within a cartridge for accommodating a developing agent which itself can be replaced as a cartridge at frequent intervals to maintain image quality as necessary. U.S. Pat. No. 4,974,023 issued on Nov. 27, 1990, to Aimoto discloses a developing device that can be structured separably into two mutually attachable and internally connectable modules such that when the developing agent of one module is spent, the two modules can be separated and the spent module discarded.

Each of these disclosed numerous means of configuring a development apparatus where the developer transporter is either a part of the toner cartridge or part of the photoreceptor cartridge. All suffer from the following limitations:

(a) the developer transporter is either a part of the removable toner cartridge or part of the removable photoreceptor cartridge which are usually disposed or recycled at frequent intervals;

(b) since the spacing between the photoreceptor and the developer transporter is critical and is very small in order to product quality copies, the cartridges are more expensive to manufacture;

(c) the development transporter must have permanent magnets within to retain the developer mix and to keep it from separating from the cartridge and falling into the copier or printer when the cartridge is being installed and removed and it too must be removed and discarded;

(d) the developer transporter requires a gear mechanism to provide motive power for the magnetic brush which causes vibration and degrades image quality;

(e) the same cartridge system cannot be used on higher speed reproduction machines because the developer transporter and the mixer are driven by fixed gearing mechanisms; and (f) these cartridges are not well-suited for ease of switching required in color image reproduction.

Ideally, since the developer mix is the only consumable material, it would be most cost-efficient if the magnetic development roller and the photoreceptor were not part of the removable cartridge. That would dramatically lower the cost of the cartridge unit and concomitantly the cost-per-copy of operating the machine. The present invention encompasses a cartridge for use in monochrome and color processing machines wherein the photoreceptor and magnetic development roller (developer transporter) is a part of the copier or printer and not part of the disposable toner cartridge. The present invention establishes a cartridge which is magnet-less, contains a sealing means and a scraper means, both of which cooperate with one another to contain the developer mix, to clean the developer transporter of the developer mix, and to seal the device. It is adapted to sealingly fit onto a copier or printer described above, transmit developer mix as needed, and, when the mixture is depleted, to be automatically sealed, then removed, and properly disposed. Removal and disposal are virtually dirt-free procedures. Such a cartridge is suited to individually develop monochrome or all four colors on the photoconductor.

The objects of the present invention therefore are:

(a) to provide a magnet-less, low-cost cartridge with recyclable and biodegradable parts;

(b) to permit easy and clean removal and replacement of spent cartridges;

(c) to provide uniform magnetic or electrostatic brush at low cost and high reliability;

(d) to provide for a color development system which uses less space and fewer parts thereby reducing design, manufacture, and maintenance costs;

(e) to provide for a well-sealed cartridge whether in transport or in operation;

(f) to provide a low-cost cartridge that can be used on higher speed reproduction machines; and (g) to provide for a cartridge which has a scraper within which is part of the sealing mechanism of the cartridge as well as a cleaning unit for the developer transporter.

The foregoing has outlined some of the more pertinent objects of the present invention. These objects should be construed to be merely illustrative of some of the more prominent features and applications of the intended invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF SUMMARY OF THE INVENTION

The above-noted problems, among others, are overcome by the present invention. Briefly stated, the present invention contemplates a removable, sealable, magnet-less cartridge for use in a reproduction apparatus of the type having a control means to control the apparatus, a photoreceptor to receive toner through a photoreceptor path and to transfer the toner onto imaged portions of the photoreceptor, and a developer transporter of the magnetic type to carry toner in a magnetic brush to the imaged portions of the photoreceptor and to return unspent toner therefrom. The magnet-less cartridge device has a housing adjacent to the developer transporter; a developer mix hopper and a mixer within the housing for holding and mixing toner and a carrier therefor in the form of a developer mix; a scraper at an open end of the housing in communicating adjacency of the developer transporter; and a sealing means comprised of a first movable sealing member, a second movable sealing member, and the scraper, each of which are adjacent to the open end of the housing to seal said cartridge in a plurality of sealing phases.

The foregoing has outlined the more pertinent and important features of the present invention in order that the detailed description of the invention that follows may be better understood so the present contributions to the art may be more fully appreciated. Additional features of the present invention will be described hereinafter which form the subject of the claims. It should be appreciated by those skilled in the art that the conception and the disclosed specific embodiment may be readily utilized as a basis for modifying or designing other structures and methods for carrying out the same purposes of the present invention. It also should be realized by those skilled in the art that such equivalent constructions and methods do not depart from the spirit and scope of the inventions as set forth in the appended claims.

BRIEF DESCRIPTION OF THE DRAWINGS

For a fuller understanding of the nature and objects of the invention, reference should be had to the following detailed description taken in conjunction with the accompanying drawings in which.

DETAILED DESCRIPTION OF THE INVENTION

Figure 1:
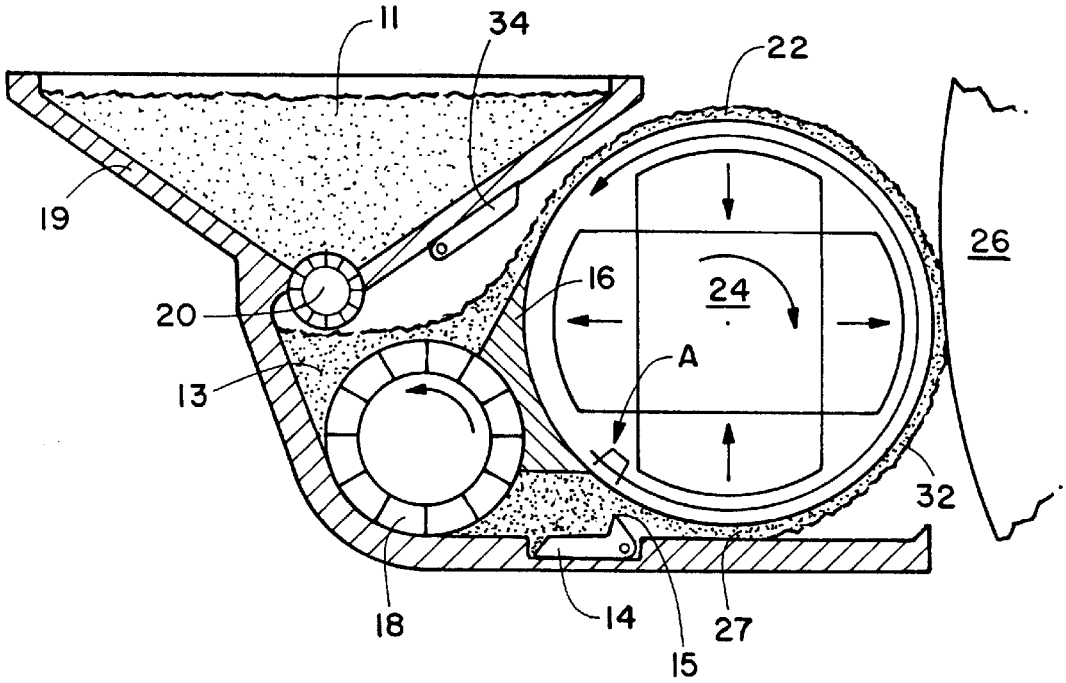
FIG. 1 cross-section schematic view of the cartridge device attached to a copier or printer.

Referring now to the drawings in detail and in particular to FIG. 1, reference character 10 generally designates a removable, sealable, magnet-less developer cartridge constructed in accordance with a preferred embodiment of the present invention. FIG. 1 shows the cartridge device 10 as it would appear sealingly attached to a developer transporter 22 on a copier or printer (not shown and hereafter referred to as reproduction apparatus). Persons skilled in the art will immediately recognize and appreciate that the present invention, the removable sealable cartridge device, is suited to all types of reproduction apparatuses which have a photoreceptor and a toner transporter mechanism (hereafter referred to a developer transporter). In this regard, the developer transporter 22 may be rotatable or non-rotatable. Within the developer transporter 22 there is a magnetic member 24 which may be a switchable electromagnet or a permanent magnet, either of which may be fixed or may be rotatable or any combination thereof.

Figure 2:
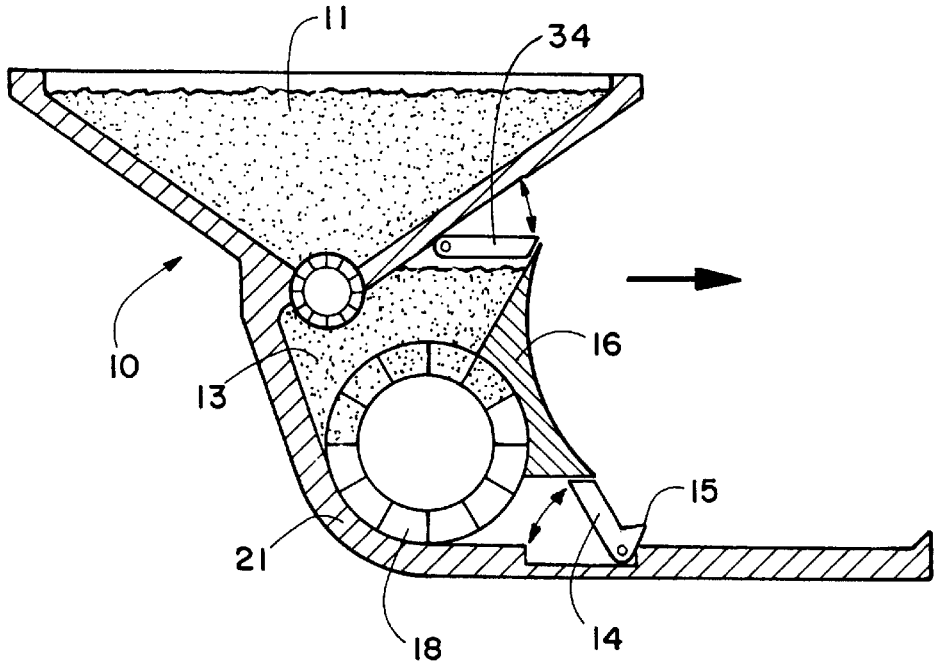
FIG. 2 is the same view as FIG. 1 showing the cartridge device after it has been removed.
Figure 3:
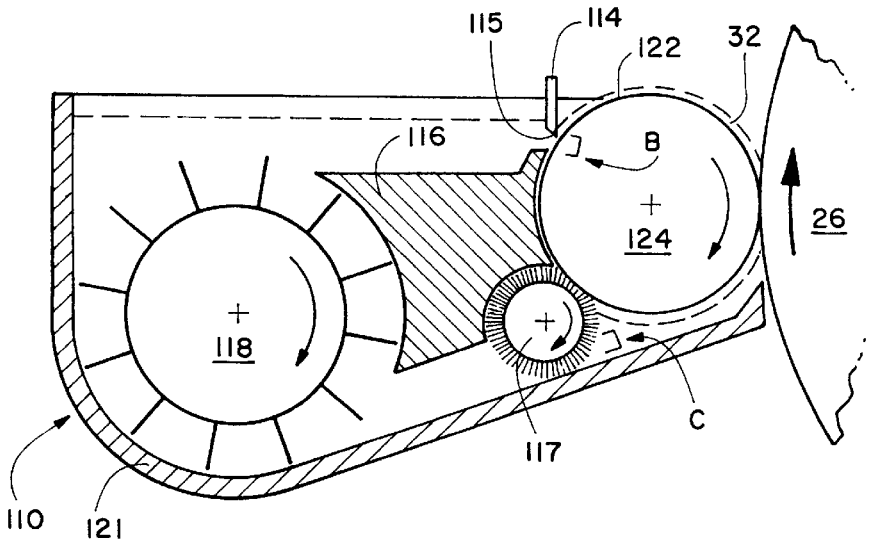
FIG. 3 cross-section schematic view of another embodiment of the cartridge device attached to a copier or printer.

The magnetic member 24 shown in FIG. 1 is a rotatable permanent magnet. FIG. 2 shows the cartridge device 10 after it has been removed from the reproduction apparatus. In this embodiment of the present invention which shows a dual-component system, the cartridge device 10 has a sealing mechanism (generally comprising a first sealing member [shown here to be a first movable shutter 14], a scraper 16, and a second sealing member [shown here to be a second movable shutter 34]), a toner hopper 19 (for holding toner), a developer mix hopper 21 (for holding a suitable carrier for the toner), a mixer 18, and a toner metering member 20. For single component systems, only a single hopper is used such as shown in FIG. 3.

The magnetic brush 32 is initially deposited on the outer side surface of the developer transporter 22 and is passed through the first shutter 14 which trims the 'bristles' to a generally uniform height as they exit the developer mix hopper 21. This trimmed magnetic brush 32 is then carried and rotated by the developer transporter 22 into adjacency with an exterior side surface portion of the rotating photoreceptor 26. At this point, the toner constituent of the developer mix is withdrawn and transferred onto the discharge image area of the photoreceptor 26 for later transfer to a suitable medium such a paper stock. Unspent toner carried by the developer mix is then carried back into the developer mix hopper 21 for reuse.

Each of the operable elements of the present invention are operatively disposed to a conventional control means and drive means (not shown) for the purpose of regulating and controlling the operation of the cartridge device during a copy cycle (or print cycle; both of which hereafter are referred to as copy cycle) in order to attract developer mix to the developer transporter 22; to trim the attracted developer mix 13 to a uniform height thereby forming a magnetic brush 32; to rotate, in this embodiment, mechanically, electrically, or magnetically the developer transporter 22 in order to carry the developer mix 13 to the photoreceptor 26 which has thereon predetermined images; to transfer toner from the developer mix 13 onto the discharged image areas of the photoreceptor 26; and to return un-spent toner and developer mix 13 to the developer mix hopper 21. The control means also engages the sealing mechanism of the cartridge, as necessary, when it is inserted onto a suitable reproduction apparatus or when it is being removed therefrom.

For the purpose of facilitating and simplifying the manner of operation, and not by way of limitation, the cartridge device 10 has at least two phases modes: (1) the sealed phase; and (2) the operational phase; each controlled by the control means of the reproduction apparatus. It must be understood that the scraper 16 is an integral part of the sealed phase. The sealed phase further has an interim sealed phase and a complete sealed phase; and the operational phase further has an active phase and an inactive phase. These are described below.

In the interim phase, the first sealing member 14 closes, the magnetic brush is generally maintained for a predetermined period, and the second sealing member 34 may remain open or may remain open only for a predetermined period after which it closes. This predetermined period for the second sealing member 34 to remain open generally may be of sufficient duration so as to permit unused developer mix 13 on the developer transporter 22 to be carried back into the developer mix hopper 21.

In the complete sealed phase, both sealing members 14, 34 are closed. FIG. 1 shows each such sealing member to be open whereas FIG. 2 shows each to be closed.

In the operational phase, the first sealing member 14 is open and the second sealing member 34 is open. The opening of the second sealing member 34, however, may be immediate or delayed. The developer transporter 22 initiates transport of developer mix 13 from the developer mix hopper 21 through the open first sealing member 14 at a point generally designed by reference character "A" in FIG. 1. A magnetic brush 32 established and the developer mix 13 is transported to the photoreceptor for transfer to the imaged portion of the photoreceptor 26. The 'bristles' are trimmed by a trimming member 15 adjacent to the first sealing member 14. Un-spent toner from the developer mix 13 is transported past the open second sealing member 34 and returned to the developer mix hopper 21. The scraper 16 may or may not be initiated to clean the developer transporter 22 of all developer mix 13. This option is controlled by the control means of the reproduction apparatus and is dependent on the needs of the user and the copying process involved. In the preferred embodiment, the scraper 16 is in cleaning contact with the developer transporter 22.

The active phase and the inactive phase of the operational phase are similar except that, in the inactive phase, the developer transporter 22 does not transport any developer mix 13, but is paused and at the ready to enter the active phase as necessary.

When the cartridge device 10 is new and to be installed on a reproduction apparatus, or when it is to be removed from a reproduction apparatus, it is in, or will enter into, the complete sealed phase. In this phase, installation and removal become virtually dirt-free evolutions.

In operation, each copy cycle will generally have a "start" mode and a "stop" mode. In the start mode, the control means places the cartridge device 10 into the operational phase and in working communication with the reproduction apparatus. In this regard, the first and second sealing members 14, 34 are open, the developer transporter 22 initiates transport of the developer mix 13, developer mix 13 is trimmed and a uniform magnetic brush 32 is established, developer mix 13 is transported to the photoreceptor 26 for transfer of toner thereunto, and un-spent toner is returned to the developer mix hopper 21 through the opened second sealing member 34. The scraper 16, may or may not be programmed to clean excess developer mix 13 from the developer transporter 22. The scraper 16 is programmed to clean the developer transporter 22 in at least two instances: (1) when removal is to be next initiated; and (2) in color copying when the next toner color is to be transported and transferred to the photoreceptor. Similar cleaning may be performed for monochrome operation but is not mandatory.

Removal may be initiated by a user for maintenance or it may be controlled by the control means when toner depletion is detected and replacement is necessary. Upon either of these instances, the scraper 16 will clean the developer transporter 22 of excess developer mix 13. The scraper 16, in combination with the closure of the first sealing member 14 to prevent additional developer mix 13 from entering the photoreceptor path 27, ensures a clean developer transporter 22 and a clean outside surface of the cartridge device 10. In color copying machines having a plurality of cartridges [i.e., Cyan (C), Magenta (M), Yellow (Y), and Black (K)] a color-specific magnetic brush is created, collapsed, and cleaned for each respective color cycle in order to paint the image on the photoreceptor properly and to reduce the risk of contaminating the other cartridges with any one of the other colors, the control means seals the cartridge device 10, into either the compete sealed phase or the interim sealed phase, before each subsequent color cycle in order to ensure against cross-contamination of other toner colors. In a monochrome machine, the magnetic brush need only be collapsed before the in-place cartridge is being removed. The cartridge, however, may be programmed to enter an interim sealed phase or a complete sealed phase as warranted.

Figure 4:
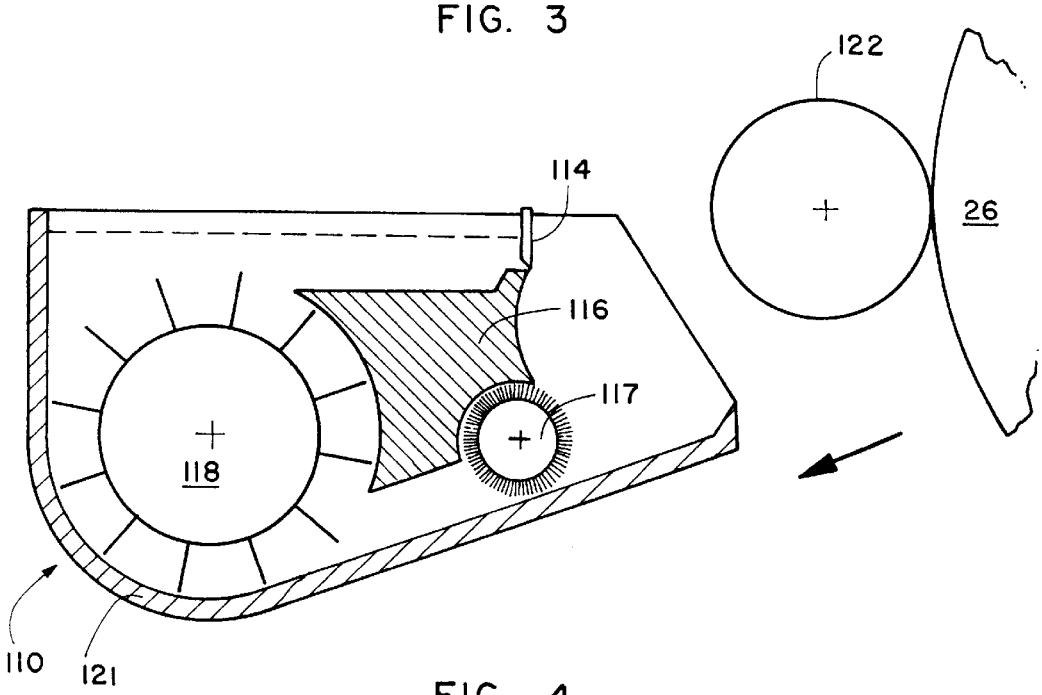
FIG. 4 is the same view as FIG. 3 showing the cartridge device after it has been removed.

Another embodiment of this invention is shown in FIGS. 3 and 4 with FIG. 3 depicting the cartridge device 110 removably attached to a rotating developer transporter 22 of a reproduction apparatus (not shown) and FIG. 4 depicting the cartridge device 110 in its sealed phase after it has been removed from the reproduction apparatus. In this embodiment a fixed permanent magnet 124 is housed within the developer transporter 122. Developer mix 13 containing toner is held in the developer mix hopper 121 where it is mixed by mixer member 118. The first shutter 114 (first sealing member) in FIG. 3 is in the open position permitting developer mix 13 (at reference point "B") to magnetically attract and attach to the developer transporter 122 thereby forming a magnetic brush 32.

The rotation of the developer transporter 122 carries the developer mix 13 in the developer transporter 122. The trimmer member 115 of the first shutter 114 trims the magnetic brush 32 to a uniform height for transport to adjacency of the rotating photoreceptor 26 and electrostatic transfer to the imaged areas thereof. Unspent toner carried by the developer mix 13 is then carried back into the developer mix hopper 121, via the scrubber 117 whereby excess developer mix 13 is cleaned from the developer transporter 122, The scrubber 117 in this embodiment operates as the second sealing member as necessary. A scraper 116 completes the cleaning process of the developer transporter 122, as necessary, by scraping remaining traces of developer mix therefrom.

When the copy cycle terminates, the control unit causes the shutter 114, after a predetermined delay, to close, as shown in FIG. 4, thereby closing off the transport of additional developer mix 13. During this process in this embodiment, the developer transporter 22 continues to rotate and carries unspent toner and developer mix 13 back to the developer mix hopper 21 where, at the point designated by reference character "C", the developer mix is returned to the developer mix hopper 121. After a predetermined period, the developer transporter 22 ceases to rotate. Also, substantially at reference point "C", the magnetic scrubber 117 rotates to capture and return unspent developer mix 13 to the developer mix hopper 121. Final traces of developer mix 13 may be scraped by the scraper 116. After completion of a copy cycle, the control means will direct the cartridge device 110 to enter the interim sealed phase or the complete sealed phase or to maintain the operational phase but in an inactive phase, depending on the respective copying needs.

The embodiment shown by FIG. 4 reflects the cartridge device 110 in a complete sealed phase. Either cartridge device associated with the present invention may be used with single- or dual-component developer mixes, with a fixed or rotating electromagnetic or a fixed or rotating permanent magnet within the developer transporter, and with a rotating or non-rotating developer transporter. It will be appreciated by those skilled in the art that, depending on the specific configuration and physical orientation of the developer transporter and the photoreceptor, variations to the cartridge device may be accomplished following the scope of this disclosure which are suited the specific configuration and orientation of the copy machines whether for monochrome or color operation.

The present disclosure includes that contained in the present claims as well as that of the foregoing description. Although this invention has been described in its preferred forms with a certain degree of particularity, it is understood that the present disclosure of the preferred form has been made only by way of example and numerous changes in the details of construction and combination and arrangement of may be resorted to without departing from the spirit and scope of the invention. Accordingly, the scope of the invention should be determined not by the embodiment[s] illustrated, but by the appended claims and their legal equivalents.

The invention claimed is:

1. In a reproduction apparatus of the type having a control means to control the apparatus, a photoreceptor to receive toner through a photoreceptor path and to transfer the toner onto imaged portions of the photoreceptor, and a developer transporter of the magnetic type to carry toner in a magnetic brush to the imaged portions of the photoreceptor and to return unspent toner therefrom, an improved magnet-less cartridge device comprising:

a housing adjacent to the developer transporter which removably attaches to the reproduction apparatus;

a developer mix hopper within said housing for holding toner in the form of a developer mix;

a mixer member within said housing in communicating operation of the control means for mixing the developer mix;

a scraper at an open end of said housing; and a sealing means adjacent to the open end of said housing to seal said cartridge in a plurality of sealing modes, said sealing means in communicating operation of the control means.

2. The device as defined in claim 1 wherein said sealing means comprises a first sealing member movingly attached to said housing and in sealing communication with said scraper and a second sealing member movingly attached to said housing in sealing communication with said scraper.

3. The device as defined in claim 2 wherein said first sealing member has a trimming member thereon which, when said first sealing member is in a open position, said trimming member is positioned to trim the developer mix attracted from the developer mix hopper to the developer transporter.

4. The device as defined in claim 3 wherein said trimming member is adjustable so as to trim the developer mix into a plurality of heights.

5. The device as defined in claim 2 wherein one of said plurality of sealing modes of said sealing means comprises a sealed mode in which said first sealing member closes thereby preventing further developer mix from entering the photoreceptor path and said second sealing member remains open for a predetermined period in order to capture unspent developer mix being transported thereto afterwhich said second sealing member closes.

6. The device as defined in claim 2 wherein one of said plurality of sealing modes of said sealing means comprises a sealed mode in which said first sealing member closes thereby preventing further developer mix from entering the photoreceptor path and said second sealing member remains open in order to capture unspent developer mix being transported thereto.

7. The device as defined in claim 2 wherein one of said plurality of sealing modes of said sealing means comprises a sealed mode in which said first sealing member is closed and said second sealing member is closed.

8. The device as defined in claim 1 wherein said scraper is in constant contact communication with said developer transporter when said device is attached to the reproduction apparatus.

9. In a reproduction apparatus of the type having a control means to control the apparatus, a photoreceptor to receive toner through a photoreceptor path and to transfer the toner onto imaged portions of the photoreceptor, and a developer transporter of the magnetic type to carry toner in a magnetic brush to the imaged portions of the photoreceptor and to return unspent toner therefrom, an improved magnet-less cartridge device comprising:

a housing adjacent to the developer transporter which removably attaches to the reproduction apparatus;

a developer mix hopper within said housing for holding toner and a carrier therefor in the form of a developer mix;

a mixer member within said housing in communicating operation of the control means for mixing the developer mix;

a scraper at an open end of said housing; and a sealing means adjacent to the open end of said housing to seal said cartridge in a plurality of sealing modes, said sealing means comprising a first sealing member movingly attached to said housing and in sealing communication with said scraper, said first sealing member further having a trimming member thereon so as to trim the developer mix when said first sealing member is in an open position; and a second sealing member movingly attached to said housing in sealing communication with said scraper; wherein said first and second sealing members are in communicating operation of the control means.

10. The device as defined in claim 9 wherein said trimming member is adjustable so as to trim the developer mix into a plurality of heights.

11. The device as defined in claim 9 wherein one of said plurality of sealing modes of said sealing means comprises a sealed mode in which said first sealing member closes thereby preventing further developer mix from entering the photoreceptor path and said second sealing member remains open for a predetermined period in order to capture unspent developer mix being transported thereto afterwhich said second sealing member closes.

12. The device as defined in claim 9 wherein one of said plurality of sealing modes of said sealing means comprises a sealed mode in which said first sealing member closes thereby preventing further developer mix from entering the photoreceptor path and said second sealing member remains open in order to capture unspent developer mix being transported thereto.

13. The device as defined in claim 9 wherein one of said plurality of sealing modes of said sealing means comprises a sealed mode in which said first sealing member is closed and said second sealing member is closed.

14. The device as defined in claim 9 wherein said scraper is in constant contact communication with said developer transporter when said device in attached to the reproduction apparatus.

15. In a reproduction apparatus of the type having a control means to control the apparatus, a photoreceptor to receive toner through a photoreceptor path and to transfer the toner onto imaged portions of the photoreceptor, and a developer transporter of the magnetic type to carry toner in a magnetic brush to the imaged portions of the photoreceptor and to return unspent toner therefrom, an improved magnetless cartridge device comprising:

a housing adjacent to the developer transporter which removably attaches to the reproduction apparatus;

a developer mix hopper within said housing for holding toner and a carrier therefor in the form of a developer mix;

a mixer member within said housing in communicating operation of the control means for mixing the developer mix;

a scraper at an open end of said housing, said scraper being adjacent to the developer transporter and in constant contact therewith when said device is attached to the reproduction apparatus; and a sealing means adjacent to the open end of said housing to seal said cartridge in a plurality of sealing modes, said sealing means comprising a first sealing member movingly attached to said housing and in sealing communication with said scraper, said first sealing member further having an adjustable trimming member thereon so as to trim the developer mix into a plurality of heights when said first sealing member is in an open position and a second sealing member movingly attached to said housing in sealing communication with said scraper; wherein said first and second sealing members are in communicating operation of the control means.

16. The device as defined in claim 15 wherein one of said plurality of sealing modes of said sealing means comprises a sealed mode in which said first sealing member closes thereby preventing further developer mix from entering the photoreceptor path and said second sealing member remains open for a predetermined period in order to capture unspent developer mix being transported thereto afterwhich said second sealing member closes.

17. The device as defined in claim 15 wherein one of said plurality of sealing modes of said sealing means comprises a sealed mode in which said first sealing member closes thereby preventing further developer mix from entering the photoreceptor path and said second sealing member remains open in order to capture unspent developer mix being transported thereto.

18. The device as defined in claim 15 wherein one of said plurality of sealing modes of said sealing means comprises a sealed mode in which said first sealing member is closed and said second sealing member is closed.

* * * * *